US006702159B2

(12) United States Patent
Itou et al.

(10) Patent No.: US 6,702,159 B2
(45) Date of Patent: Mar. 9, 2004

(54) POURING SPOUT FOR SPARKLING BEVERAGES

(75) Inventors: Sukehide Itou, Toyoake (JP); Shigekazu Kondou, Toyoake (JP); Fumitaka Saitou, Nagoya (JP); Shunji Tsubouchi, Toyoake (JP); Eiji Hara, Toyoake (JP); Satoru Kobayashi, Chita-gun (JP); Kouji Sutou, Oobu (JP)

(73) Assignee: Hoshizaki Denki Kabushiki Kaisha, Aichi (JP)

( * ) Notice: Subject to any disclaimer, the term of this patent is extended or adjusted under 35 U.S.C. 154(b) by 62 days.

(21) Appl. No.: 10/161,468

(22) Filed: May 31, 2002

(65) Prior Publication Data

US 2003/0006254 A1 Jan. 9, 2003

(30) Foreign Application Priority Data

Jun. 8, 2001 (JP) ..... 2001-174577

(51) Int. Cl.[7] ..... B65D 83/00
(52) U.S. Cl. ..... 222/400.7
(58) Field of Search ..... 222/400.7, 400.8

(56) References Cited

U.S. PATENT DOCUMENTS 5,607,084 A * 3/1997 George ..... 222/153.03
5,617,977 A * 4/1997 Augustinus ..... 222/400.7
5,813,574 A * 9/1998 McNabb ..... 222/146.6
6,398,084 B2 * 6/2002 Maruyama et al. ..... 222/504

* cited by examiner

*Primary Examiner*—Joseph A. Kaufman
(74) *Attorney, Agent, or Firm*—Koda & Androlia

(57) ABSTRACT

A first operation of a lever causes a valve rod to retract axially through a second valve element seated on a second valve seat against a first resilient part, while a first valve element to leave a first valve seat open to pour beer from a beer pouring nozzle through a beer supply channel. A second operation of the lever causes a slider to advance axially against a second resilient part to be spaced away from the valve rod forcing the first valve element to be seated on the first valve seat, while the second valve element to leave the second valve seat open to effect frothing of the beer from a liquid passage and pour the resulting froth through holes defined in a sleeve.

9 Claims, 13 Drawing Sheets

POURING SPOUT FOR SPARKLING BEVERAGES

BACKGROUND OF THE INVENTION

1. Field of the Invention

The present invention relates to a pouring spout for sparkling beverages, more specifically to an improvement of spout, which is used in a sparkling beverage server or dispenser capable of pouring a sparkling beverage typified by beer under operation of a lever and which can additionally pour, after pouring of a predetermined quantity of the beverage into a vessel such as a mug, fine froth over the beverage in the vessel.

2. Description of the Related Art

Some pouring spouts to be used in apparatuses for pouring sparkling beverages by operating levers, for example, in beer servers, have a function of additionally pouring, after pouring a predetermined quantity of beer into a mug by tilting a lever manually in one direction, fine beer froth over the beer in the mug. As a pouring spout having such a froth adding function, there is disclosed a spout having a frothing function in Japanese Unexamined Patent Publication No. 9-2590. The reason why such fine froth is additionally poured over the beer in a mug is that appropriately frothed beer gives improved texture when the beer goes through ones throat and that the froth prevents carbon dioxide gas from escaping quickly from the beer. Recently, froth to be poured additionally after pouring of beer is required to be as fine as cream.

In a beer server having such a frothing function, a lever attached to a beer pouring spout is switched over to pour beer only or to additionally pour froth from a single nozzle provided in the spout. Therefore, fine froth passes through the nozzle of the beer pouring spout after passage of beer through it, or vice versa. However, it is essential in pouring draft beer from a beer server that there is no residue of beer and froth thereof on the internal surface of the nozzle so as to achieve appropriate frothing of the draft beer poured through it. If beer is poured to another mug with the beer or froth remaining on the internal surface of the nozzle, frothing is likely to occur excessively to give foamy beer. A countermeasure is taken for it by defining an air inlet hole in the pouring nozzle to let the beer and froth remaining on the internal surface of the nozzle drip by their own weights.

As mentioned already, it is true that finely divided creamy foam is required as the additional froth, but creamy froth is highly viscous, so that it is difficult and also takes time to discharge the froth with the aid of air supplied through the air inlet hole. Therefore, it is necessary for an operator, after pouring beer into a mug and carrying out the froth adding operation, to operate the lever in a flash so as to pour liquid beer to flush froth remaining in the spout body and nozzle away from them. However, this operation of flushing the spout body and nozzle with beer inevitably requires a lot of skill, so that there has been awaited an advent of a beer pouring spout capable of pouring constantly fine froth of high quality requiring no such a skill.

Meanwhile, a spout for pouring sparkling beverages is disclosed in Japanese Patent Application No. 2000-19102 filed according to the proposition of the Applicant of the present invention. This spout has a nozzle for pouring a liquid into a mug and another nozzle for pouring froth into the mug, and also contains in its body various kinds of valve mechanisms for opening and closing a liquid channel and a froth channel defined so that a liquid and froth can be poured separately from the respective nozzles.

In the spout for pouring a sparkling beverage described above, the nozzle for pouring froth is long, so that a large amount of froth remains on the internal surface of the nozzle, which is causative of marring the flavor of the liquid. This problem cannot be solved merely by shortening the froth pouring nozzle. If a short froth pouring nozzle is merely used, a vigorous turbulent flow of froth is injected into a mug to be causative of excessive frothing and to be a hindrance in forming fine froth of high quality.

The present inventor has already proposed a countermeasure for the above problem and filed a Japanese Patent Application No. 2001-137771 relating to an invention entitled "Pouring spout for sparkling beverages." In the pouring spout according to this invention, a slider is provided in the spout body such that it can slide within a liquid passage defined in its body in intimate contact with the passage under operation of a lever connected to the slider. Meanwhile, a valve seat provided on one end face of the slider is normally urged, by a resilient part attached to the other end face of the slider, to be pressed against the froth pouring valve element and closes the opening of an orifice defined in the froth pouring valve element to communicate with a through hole through which a sparkling beverage passes. When the slider is slid toward the resilient part against the resilience of, the valve seat retracts from the froth pouring valve element to open the opening of the orifice, through which the beverage flows out to impinge against the valve seat and undergoes frothing, and the thus obtained froth is designed to flow to the froth pouring nozzle through an annular groove formed on the internal surface of the spout body.

According to the constitution, the froth formed by impingement of a sparkling beverage against the valve seat is allowed to flow through the annular groove defined in the spout body into the froth pouring nozzle, and thus the impetus of the froth flowing into the nozzle can be attenuated to prevent favorably excessive frothing occurring when a short froth pouring nozzle is used.

However, in the sparkling beverage pouring spout described above, when a liquid or froth thereof is poured, the liquid or froth is brought into contact with the internal surface of the liquid passage defined in the spout body and partly with the slider and remain there. Since the slider repeats sliding in intimate contact with the internal surface of the liquid passage of the spout body under tilting operation of the lever in each time the liquid or froth is poured, the liquid is applied to the internal surface of the liquid passage in the spout body over the full length of the passage and remains there. Thus, the external surface of the slider sliding in intimate contact with the internal surface of the liquid passage defined in the spout body is caused to assume airtightness due to the liquid applied to the passage and remains there.

Meanwhile, if the slider is moved away in a direction such that the valve seat retracts from the froth pouring valve element when froth is to be poured through the sparkling beverage pouring spout, the resilient part retained between the slider and the stopper is pressed against the stopper and is compressed, and the volume of the space in which the stopper and the slider are housed reduces. In this case, due to the high airtightness between the slider and the internal surface of the spout body brought about by the liquid remaining there as described above, the air having been present in that housing space is already ejected along the external surface of the stopper having a lower resistance to airtightness to the outside of the pouring spout. The beer liquid contains a foaming component, so that when the air is ejected along the external surface of the stopper, foaming occurs inevitably accompanied by ejection of the beer liquid. In other words, the ejected beer liquid seeps to the outside of the spout body to deposit thereon, causing contamination of the spout body, disadvantageously.

On the other hand, it is contemplable, as techniques of preventing foaming, in a beer spout structure as disclosed in Japanese Unexamined Patent Publication No. 2000-318799, to notch partly a cover corresponding to the stopper and facilitate incoming and outgoing of air, or to define a through hole in the spout body communicating to the outside. However, these structures are all accompanied by leakage of beer liquid from the spout body to the outside, and wetting of the external surface of the spout body with the seeped beer liquid occurs unavoidably, causing contamination of the external surface.

Meanwhile, Japanese Unexamined Patent Publication No. 2000-318799 discloses a valve mechanism, in which a froth switching valve is contained in a cavity of a first movable rod, and a pressurized beer liquid is allowed to flow into a sliding clearance between the cavity of the first movable rod and a second movable rod by tilting an operation lever clockwise to open the valve. The beer liquid is then injected through orifices defined in an annular U-shaped groove formed on the first movable rod to the external surface of the first movable rod to effect frothing of the beer liquid, and the resulting froth is poured from a froth pouring port through the U-shaped groove. During pouring of froth, the annular U-shaped groove having the orifices for injecting the beer liquid is positioned in alignment with the froth pouring port, and the froth formed through ejection of the beer liquid through the orifices partly forms turbulence and flows down vigorously to the froth pouring port. Therefore, the length of the froth pouring nozzle is increased.

Since the sparkling beverage pouring spout has a long froth pouring nozzle, it involves a problem that a large quantity of froth remains on the internal surface of the nozzle to cause marring of the taste of the beverage. This problem cannot be solved merely by using a short pouring nozzle, but the short froth pouring nozzle injects a vigorous turbulence of froth into a mug, causing excessive frothing or being a factor preventing formation of fine froth of high quality.

Further, the conventional pouring spouts for sparkling beverages involve problems that if the froth remained around the resilient part such as a coiled spring is not discharged but is exposed to the outside air for a long time, it undergoes deterioration, so that the pouring spout must be disassembled and cleaned frequently, taking much trouble, and that the pouring spouts have structures difficult to disassemble.

SUMMARY OF THE INVENTION

The present invention was accomplished with a view to solving suitably the problems inherent in the pouring spouts for sparkling beverages of the prior art as described above and is directed to providing a pouring spout for sparkling beverages enabling unskilled operators to carry out appropriate addition of fine and highly viscous froth without requiring the sophisticated skill of cleaning the nozzles and the like with a sparkling beverage nor causing excessive frothing.

Further, the present invention was accomplished with a view to solving suitably the problems inherent in the pouring spouts for sparkling beverages described above and is directed to providing a clean and hygienic pouring spout for sparkling beverages capable of preventing wetting of the spout body with the seeped beverage.

Further, the present invention was accomplished with a view to solving suitably the problems inherent in the pouring spouts for sparkling beverages described above and is directed to providing a pouring spout for sparkling beverages which controls turbulence in pouring froth to prevent excessive frothing and which facilitates disassembling and cleaning.

In order to solve the problems described above and to attain the intended objectives, the pouring spout for a sparkling beverage according to one aspect of the present invention has a constitution in which the sparkling beverage is poured into a vessel by a first operation of a lever, and froth of the sparkling beverage is poured additionally into the vessel by a second operation of the lever; and is characterized in that the pouring spout has a sparkling beverage pouring nozzle and a froth pouring nozzle branching out from a sparkling beverage supply channel defined in a spout body; a slider inserted to the sparkling beverage supply channel to be slidable therein and is connected to the lever to be driven thereby to advance and retract; a sleeve inserted slidably into the sparkling beverage supply channel and is connected at one end to the slider; the sleeve having through holes defined in the peripheral wall to be able to communicate with the froth pouring nozzle at the time of froth pouring operation; a first valve element to be seated on a first valve seat provided at an inlet of the sparkling beverage supply channel under an action of a first resilient part; a valve rod connected at one end to the first valve element and is inserted at the other end to the sleeve; the valve rod having a liquid passage defined axially therein to penetrate the first valve element; and a second valve element inserted to the sleeve and is connected at one end to the valve rod, the second valve element having an orifice defined at the other end to communicate with the liquid passage, that end having the orifice being seated on a second valve seat provided in the slider under an action of a second resilient part; wherein, before operation of the lever, the first valve element is seated on the first valve seat to interrupt flowing of the sparkling beverage into the sparkling beverage supply channel, whereas the second valve is seated on the second valve seat to close the orifice; the first operation of the lever retracts the valve rod in the axial direction against the first resilient part through the second valve element being seated on the second valve seat to let the first valve element leave the first valve seat open and to pour the sparkling beverage out of the sparkling beverage pouring nozzle through the sparkling beverage supply channel; the second operation of the lever causes the slider to advance in the axial direction against the second resilient part to be spaced away from the valve rod forcing the first valve element to seat on the first valve seat, and also causes the second valve element to leave the second valve seat open and effect frothing of the sparkling beverage from the liquid passage when it flows through the orifice to pour the resulting froth from the froth pouring nozzle through the through holes defined in the sleeve.

Here, the sleeve has on the external surface a first annular groove and a second annular groove defined at a necessary interval therebetween, whereas the spout body has a first air vent and a second air vent to allow the sparkling beverage supply channel to communicate with the outside; the sparkling beverage pouring nozzle and the froth pouring nozzle are designed to communicate with the first air vent and the second air vent through the first annular groove and the second annular groove, respectively, only at a fixed position of the sleeve before operation of the lever.

The first operation of the lever interrupts communication between the first annular groove and the first air vent to stop introduction of the outside air into the sparkling beverage pouring nozzle, while communication between the second annular groove and the second air vent is maintained to introduce outside air still into the froth pouring nozzle. Meanwhile, the second operation of the lever interrupts communication between the second annular groove and the second air vent to stop introduction of the outside air into the froth pouring nozzle, while communication between the first annular groove and the first air vent is maintained to introduce outside air still into the sparkling beverage pouring nozzle.

In order to solve the problems described above and to attain the intended objectives, the pouring spout for a sparkling beverage according to another aspect of the present is provided with a slider sliding within a liquid passage defined in a spout body in intimate contact therewith; a lever connected to the slider and is tilted to slide the slider within the liquid passage; a resilient part disposed on one end face of the slider so as to press a valve seat provided on the other end face of the slider against a pouring valve element disposed to oppose the latter end face; a through hole for the sparkling beverage defined in the inside of the pouring valve element and opens to that end face against which the valve seat for the pouring valve element is pressed; a pouring nozzle providing a channel of the sparkling beverage flowed out from an opening of the through hole opened by retraction of the valve seat from the pouring valve element when the slider is slid toward the other end face against the resilience of the resilient part; and a communicating passage for securing communication between a housing space defined in the spout body, in which the resilient part is housed and the pouring nozzle.

In order to solve the problems described above and to attain the intended objectives, the pouring spout for a sparkling beverage according to another aspect of the present invention is provided with a slider sliding within a liquid passage defined in a spout body in intimate contact therewith; a lever connected to the slider and is to be tilted to slide the slider within the liquid passage; a resilient part disposed on one end face of the slider so as to press a valve seat provided on the other end face of the slider against a froth pouring valve element disposed to oppose the latter end face; an orifice defined as a passage for the sparkling beverage introduced into the froth pouring valve element and opening to the froth pouring valve element; an annular groove defined on the internal surface of the spout body such that it provides a channel for froth formed when the sparkling beverage flowed out through the opening opened by retraction of the valve seat from the froth pouring valve element by sliding the slider toward that former end face against the resilience of the resilient part impinge against the valve seat; and a froth pouring nozzle communicating with the annular groove.

Other aspects and advantages of the invention will become apparent from the following description, taken in conjunction with the accompanying drawings illustrated by way of examples the principles of the invention.

BRIEF DESCRIPTION OF THE DRAWING

The features of the present invention that are believed to be novel are set forth with particularity in the appended claims. The invention together with the objects and advantages thereof, may best be understood by reference to the following description of the presently preferred embodiments together with the accompanying drawings in which:

DETAILED DESCRIPTION OF THE PREFERRED EMBODIMENTS

The pouring spout for sparkling beverages according to the present invention will be described below by way of preferred embodiments referring to the attached drawings. In the following embodiments, the pouring spout for sparkling beverages are explained by giving beer pouring spouts, for example, to be attached to beer servers.

Figure 1:
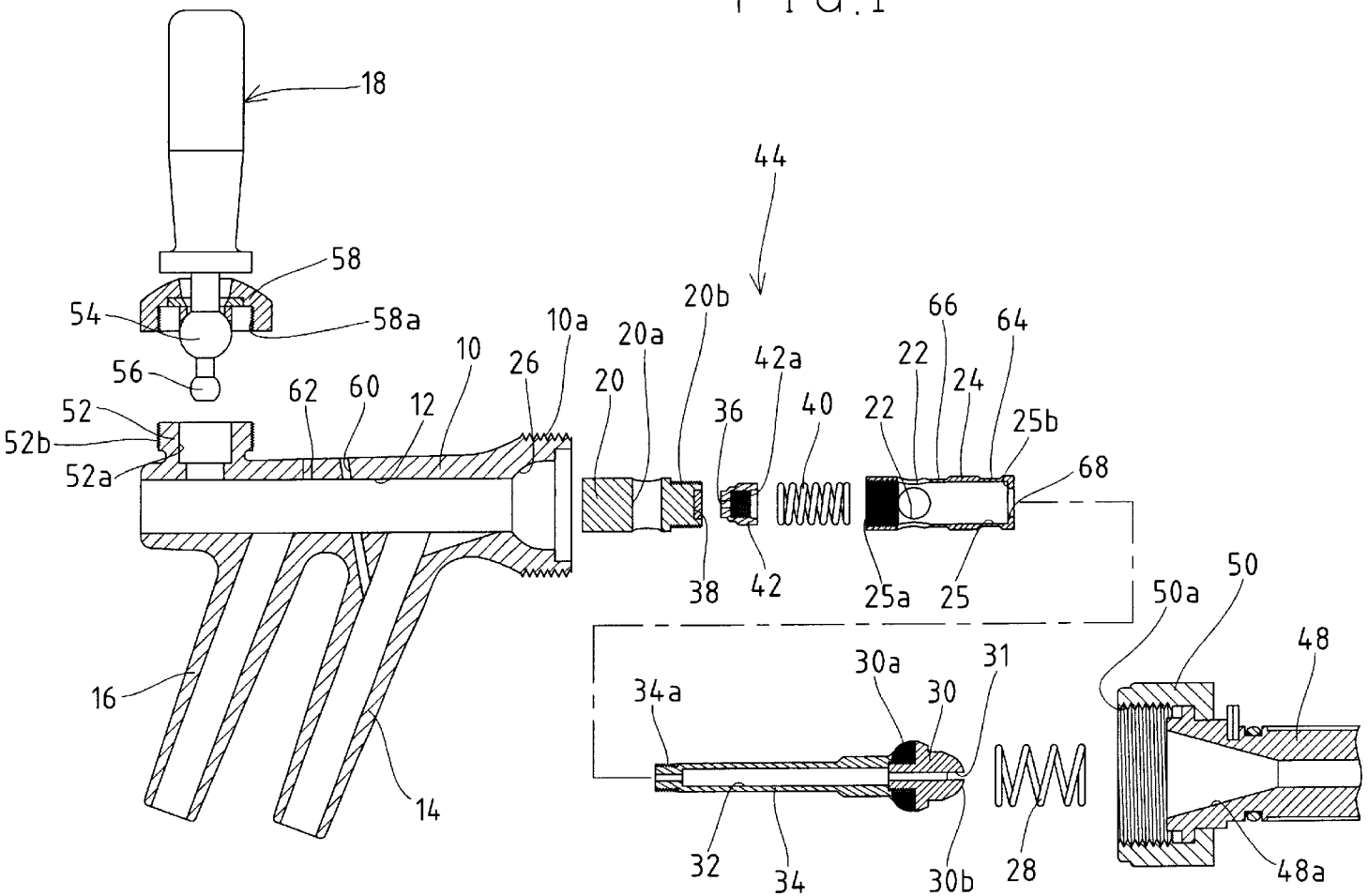
FIG. 1 is an exploded cross-sectional view showing components constituting the pouring spout for sparkling beverages according to a preferred embodiment of the invention.
Figure 2:
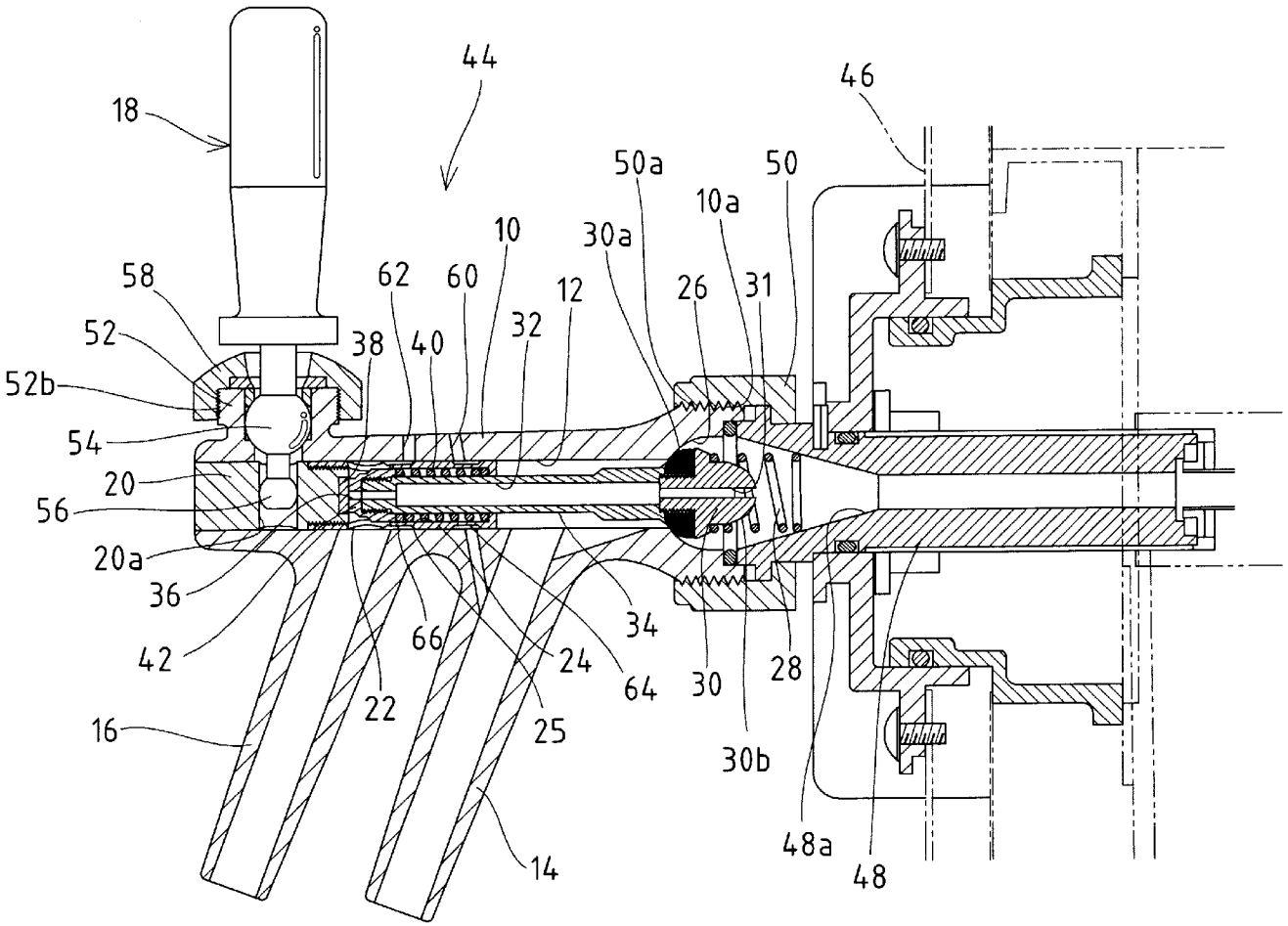
FIG. 2 is a cross-sectional view of the pouring spout for sparkling beverages according to the embodiment connected to a beverage supply pipe of a beverage server, showing a state where the lever is not operated yet but is located at the neutral position, and the spout is pouring neither a sparkling beverage nor froth thereof.
Figure 8:
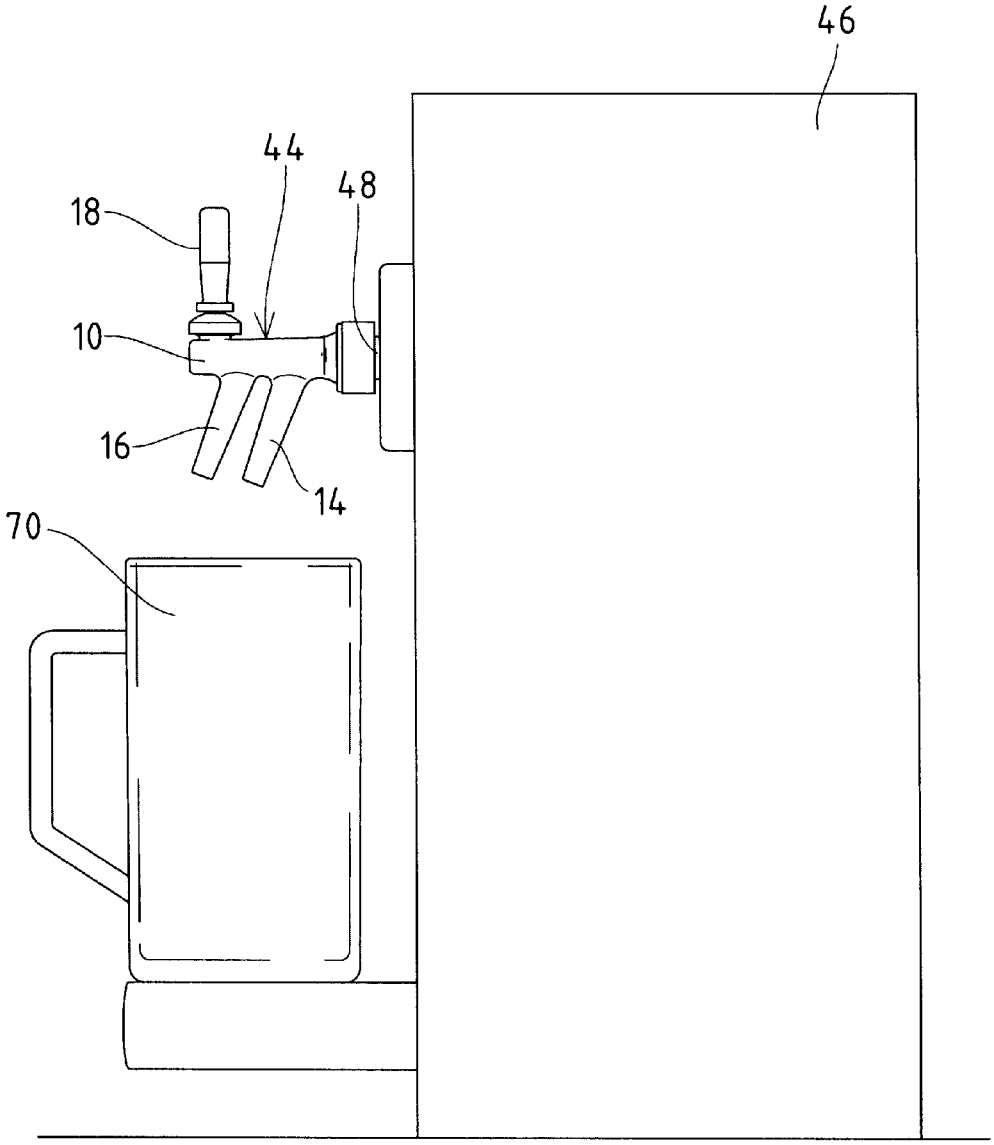
FIG. 8 is a side view of a sparkling beverage server provided with the pouring spout for sparkling beverages according to the preferred embodiment.

FIG. 1 is an exploded cross-sectional view showing a beer pouring spout 44 according to a preferred embodiment of the invention. The beer pouring spout 44 is attached to a beer server 46 shown in FIG. 8. Meanwhile, FIG. 2 is a cross-sectional view of the beer pouring spout 44 connected to a beer supply pipe extended horizontally from the beer server 46, showing a state where the spout is pouring neither a sparkling beverage nor froth thereof. The beer pouring spout 44 consists essentially of a spout body 10, various kinds of valve mechanisms (to be described later) housed in the spout body 10 to carry out operations of opening and closing beer channel and froth channel respectively, and a lever 18 to be tilted to carry out switching between a beer pouring position and a froth pouring position, as shown in FIG. 1.

The spout body 10 shown in FIG. 1 contains a beer supply channel 12 having a necessary diameter running horizontally through the body 10 and a pair of pouring nozzles branching out diagonally downward therefrom parallel to each other, i.e., one is a beer pouring nozzle 14 and the other is a froth pouring nozzle 16. These two nozzles 14 and 16 communicate with each other within the beer supply passage 12. In FIG. 1, the right nozzle extended from the spout body 10 diagonally downward is the beer pouring nozzle 14 and the left nozzle is the froth pouring nozzle 16.

In FIG. 1, the diameter of the spout body 10 is enlarged at the right end to form a large diameter portion containing a hemispherical cavity 26 to which the beer supply channel 12 opens. This hemispherical cavity 26 functions as a first valve seat to be explained later. The spout body 10 is fitted to a beer supply pipe 48 by engaging a male screw 10*a* formed on the external surface of the large diameter portion with a female screw 50*a* of a union nut 50 shown in FIG. 2. The spout body 10 has on the left side a rising portion 52 formed integrally therewith. The rising portion 52 contains a vertical hole 52*a* communicating with the beer supply passage 12, and a ball 54 and a connecting rod 56 provided at the lower end of the pouring operation lever 18 are designed to be inserted to the vertical hole 52*a*. The connecting rod 56 is inserted to an inserting hole 20*a* of a slider 20 (to be described later) and transmits the movement of the lever 18 thereto. Here, the lever 18 is incorporated into the spout body 10 by engaging a male screw 52*b* formed on the external surface of the rising portion 52 with a female screw 58*a* of a union nut 58 attached to the ball 54 of the lever 18.

Further, the spout body 10 has a first air vent 60 and a second air vent 62 securing communication of the beer supply channel 12 with the outside. These two air vents 60 and 62 function to achieve connection and disconnection of the beer pouring nozzle 14 and the froth pouring nozzle 16 to and from the outside, in cooperation with a first annular groove 64 and a second annular groove 66 defined on the external surface of a sleeve 24 (to be described later) at a necessary interval. In FIG. 1, the first air vent 60 locates on the right side, one end of which opens to the upper surface of the spout body 10, and the other end opens to the beer pouring nozzle 14. Meanwhile, the second air vent 62 locates on the left side of the first air vent 60 in FIG. 1 with a predetermined interval being secured between them, and opens to the upper surface of the spout body 10. The distance between the first air vent 60 and the second air vent 62 opening to the beer supply pipe 12 is designed to correspond to the distance between the first annular groove 64 and the second annular groove 66 (to be described later).

The beer supply channel 12 in the spout body 10 contains various kinds of valve mechanisms for opening and closing the beer channel and froth channel respectively. The valve mechanisms consist essentially of the slider 20, the sleeve 24, a valve rod 34, a first valve element 30, a first valve seat 26, a first resilient part 28, a second valve element 42, a second valve seat 38, a second resilient part 40, etc.

In FIG. 1, the reference number 20 denotes a cylindrical slider inserted slidably to the beer supply channel 12 substantially in intimate contact therewith, and the slider 20 has the inserting hole 20*a* defined substantially at the middle orthogonal to the axis thereof. When the pouring spout 44 is to be assembled, the connecting rod 56 provided at the lower end of the lever 18 is inserted to this inserting hole 20*a*, and the slider 20 is advanced and retracted by tilting the lever 18 forward and backward. While the slider 20 has a cylindrical recess defined on the right end thereof in FIG. 1, in which a sealing body 38 is fitted. The sealing body 38 functions as the second valve seat permitting seating of the second valve element 42 thereon. Here, the slider 20 has a male screw 20*b* formed on the external surface at the right end portion thereof, which is engaged with a female screw 25*a* formed on the internal surface of the sleeve 24 (to be described later) on the left end portion to achieve connection between the slider 20 and the sleeve 24.

In FIG. 1, the reference number 24 denotes a cylindrical sleeve to be inserted into the beer supply channel 12 to be slidable therein and substantially in intimate contact therewith. The sleeve 24 contains a cylindrical cavity 25 running axially through it. The female screw 25*a* formed on the internal surface of the cylindrical cavity 25 on the left side is engaged with the male screw 20*b* of the slider 20. Meanwhile, the right end portion of the cylindrical cavity 25 is provided with an inside step 25*b* which functions as a positioning face for the second resilient part 40 (to be described later) inserted to the cylindrical cavity 25. Further, the inside step 25*b* has a valve rod inserting hole 68 communicating with the cylindrical cavity 25 to admit insertion of the valve rod 34 (to be described later) thereto.

The first annular groove 64 and the second annular groove 66 are formed on the external surface of the sleeve 24 at a predetermined interval to achieve connection and disconnection to and from the beer pouring nozzle 14 and the froth pouring nozzle 16 in cooperation with the first air vent 60 and the second air vent 62 defined in the spout body 10, respectively. In FIG. 1, the first annular groove 64 and the second annular groove 66 of the sleeve 24 are located on the right side and on the left side respectively. The distance between the first annular groove 64 and the second annular groove 66 is adapted to correspond to the distance between the first air vent 60 and the second air vent 62, as explained already. Further, four through holes 22 are defined radially in the sleeve 24 to communicate with the cylindrical cavity 25 with the right edge portion of each through hole 22 overlapping with the second annular groove 66. These through holes 22 can be allowed to communicate with the froth pouring nozzle 16 by shifting the lever 18 (to be described later) to the froth pouring position.

As mentioned already, the large diameter portion of the spout body 10 has a hemispherical recess serving as the first valve seat 26, which communicates with the inlet of the beer supply channel 12. Further, the first valve element 30 is designed to be seated on the first valve seat 26 to achieve freely connection and disconnection between the beer supply pipe 48 and the beer supply channel 12. The first valve element 30 is urged resiliently by the first resilient part 28 such as a coiled spring interposed between itself and the conical internal face 48*a* of the beer supply pipe 48 to be normally abutted against the first valve seat 26. Further, in FIG. 1, the left half of the first valve element 30 is designed to form a hemispherical rubber sealing face 30*a* to ensure liquid tightness between itself and the first valve seat 26; whereas the right half of the first valve element 30 is designed to form a spindle-shaped head 30*b*. The first valve element 30 also has a through hole 31 defined in alignment with the center axis thereof to communicate with a liquid passage 32 (to be described later) of the valve rod 34.

The valve rod represented by the reference number 34 in FIG. 1 is a long rod material having a liquid passage 32 defined through it in alignment with the center axis thereof. The valve rod 34 is connected at the right end to the first valve element 30 in FIG. 1 to allow the liquid passage 32 to communicate with the through hole 31 of the first valve element 30. The valve rod 34 also has a male screw 34*a* formed on the external surface at the left end portion. The valve rod 34 and the second valve element 42 are designed to be connected to each other by engaging the male screw 34 of the former with a female screw 42*a* formed on the internal surface of the latter. Here, the valve rod 34 is inserted to the sleeve 24 through the valve rod inserting hole 68 thereof. Further, the second resilient part 40 (to be described later) such as a coiled spring is fitted on the valve rod 34 and is interposed resiliently between the second valve element 42 (to be described later) connected to the valve rod 34 and the inside step 25*b* of the sleeve 24 to forcibly seat the second valve element 42 on the second valve seat 38 of the slider 20.

In FIG. 1, the reference number 42 denotes the second valve element to be inserted into the sleeve 24. The second valve element 42 has a cylindrical shape having a short axis, which can be housed in the sleeve 24 substantially in intimate contact therewith, and has a female screw 42*a* axially formed at the right end portion in FIG. 1. The second valve element 42 is connected to the valve rod 34 by engaging the female screw 42*a* of the former to the male screw 34*a* formed on the latter at the left end portion, as mentioned already. The second valve element 42 has a narrow hole 36 defined in alignment with the center axis thereof. By connecting the second valve element 42 and the valve rod 34 to each other in assembling the pouring spout, the narrow hole 36 communicates with the liquid passage 32 defined in the valve rod 34. The narrow hole 36 is defined so as to convert the beer coming through the liquid passage 32 into fine froth when the beer passes through it, so that the hole 36 is designed to have an inside diameter that is as very small as that of an orifice. Further, a head having a reduced diameter is formed at the left open end portion of the second valve element 42, as shown in FIG. 1, so that it can be seated on the second valve seat 38 defined in the slider 20. Here, the force of bringing the second valve element 42 into press contact with the second valve seat 38 to normally allow the former to be seated on the latter is mainly applied by the first resilient part 28 provided on the first valve element (30) side.

After the respective parts described above are organically assembled, the resulting assembly is inserted to the beer supply channel 12 of the spout body 10. In an actual assembly, the end of the valve rod 34 where the first valve element 30 is not present is inserted to the sleeve 24 through the valve rod inserting hole 68. The valve rod 34 inserted to the sleeve is further inserted to the second resilient part 40 typified by a coiled spring, and then the male screw 34*a* provided at the left end portion of the valve rod 34 is engaged with the female screw 42*a* of the second valve element 42. Here, the coiled spring 40 can be housed in the cylindrical cavity 25 of the sleeve 24, and the right end portion and the left end portion of the coiled spring 40 are controlled by the inside step 25*b* and by the second valve element 42, respectively, as shown in FIG. 2.

Next, the sleeve 24 and the slider 20 are connected to each other by engaging the female screw 25*a* formed on the internal surface of the sleeve 24 at the left end portion with the male screw 20*b* formed on the external surface of the slider 20 at the right end portion. Here, the coiled spring 40 contained in the cylindrical cavity 25 of the sleeve 24 is compressed to resiliently urge the sleeve 24 axially rightward in FIG. 2 and also to seat the second valve element 42 on the second valve seat 38. Incidentally, the coiled spring 40 is designed to have a degree of resilience such that it can urge the slider 20 leftward to retain the lever 18 at the upright position as shown in FIG. 2, provided that the resilience of the coiled spring as the second resilient part 40 is designed to be smaller than that of the coiled spring 28 as the first resilient part.

After the assembly of the various kinds of valve mechanisms is inserted to the beer supply channel 12 of the spout body 10, the lever 18 is fitted to the spout body 10. Further, the spout body 10 is fitted to the beer supply pipe 48. These fitting procedures are of public knowledge, descriptions of them will be omitted. Incidentally, since the coiled spring 28 is resiliently interposed between the first valve element 30 and the conical internal face 48*a* of the beer supply pipe 48 and is present as such after completion of assembly, the first valve element 30 is seated on the first valve seat 26 to normally interrupt communication between the beer supply pipe 48 and the beer supply channel 12.

FIG. 2 is a cross-sectional view of the beer pouring spout 44 of the embodiment having the valve mechanism assembly shown in FIG. 1 incorporated into the spout body 10. In FIG. 2, the lever 18 is not operated but is located at the neutral position, and the spout 44 is pouring neither beer nor froth thereof. More specifically, before the lever 18 is operated, the coiled spring 28 disposed in abutment with the conical internal face 48*a* of the beer supply pipe 48 resiliently urges the first valve element 30 to seat the valve element 30 on the first valve seat 26 and cuts off supply of beer from the beer supply pipe 48 to the beer supply channel 12. Further, since the second valve element 42 connected to the valve rod 34 is urged by the coiled spring 28 axially leftward, the second valve element 42 is seated on the first valve seat 26 provided in the slider 20 to close the narrow hole 36 of the second valve element 42. Thus, neither beer nor froth thereof is supplied to the beer pouring nozzle 14 or to the froth pouring nozzle 16.

Figure 3:
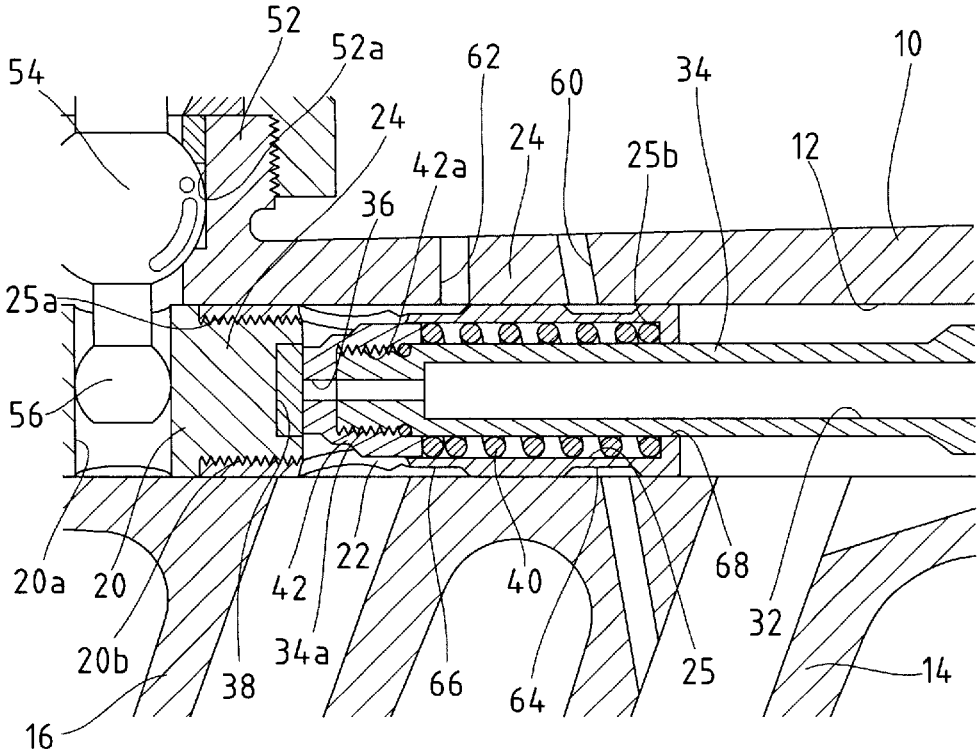
FIG. 3 is an enlarged view of a pertinent portion of the pouring spout for sparkling beverages showing the positional relationship of the sleeve in FIG. 2.

Further, as shown in FIG. 3, when the lever 18 is at the neutral position, the first annular groove 64 and the second annular groove 66 are defined on the external surface of the sleeve 24 are adapted to oppose the first air vent 60 and the second air vent 62 defined in the spout body 10, respectively. Therefore, the outside air is introduced in the following two routes: (1) first air vent 60→first annular groove 64→beer pouring nozzle 14; and (2) second air vent 62→second annular groove 66→froth pouring nozzle 16. In other words, the beer remaining on the internal surface of the beer pouring nozzle 14 after the immediately preceding beer pouring operation can be caused to drop easily by introduction of air, whereas the portion of froth remaining on the internal surface of the froth pouring nozzle 16 after the immediately preceding froth pouring operation can be also caused to drop easily by introduction of air.

Figure 4:
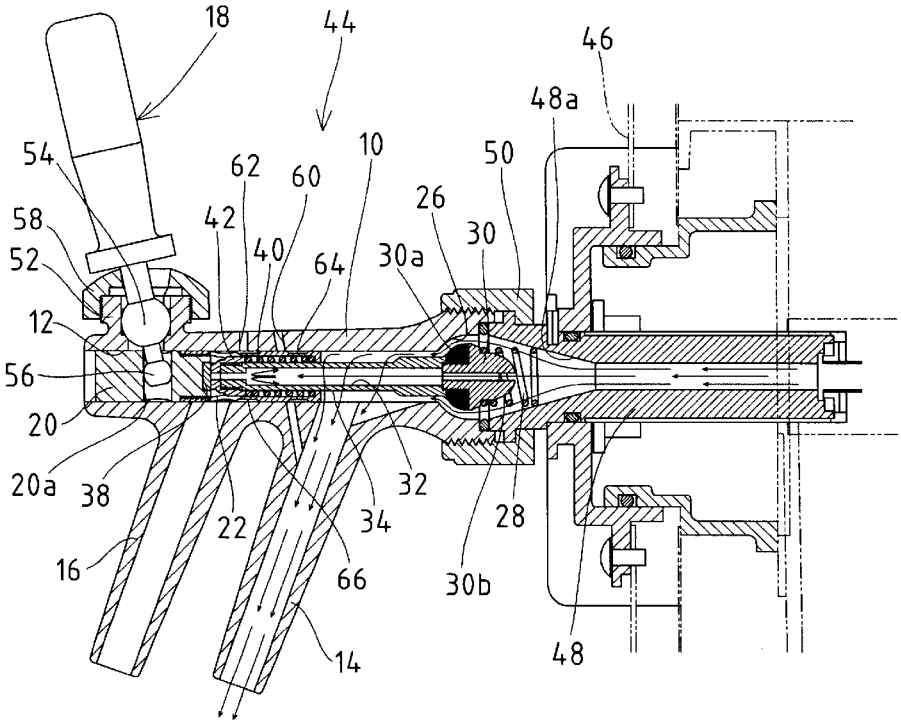
FIG. 4 is a cross-sectional view of the pouring spout for sparkling beverages according to the embodiment connected to the beverage supply pipe of a beverage server, showing a state where only a sparkling beverage is poured by a first operation of the lever.

As shown in FIG. 4, when the lever 18 is tilted endways (this operation is referred to as a first operation), the slider 20 retracts rightward within the beer supply channel 12. Since the slider 20 is connected to the sleeve 24, and since the valve rod 34 connected end-to-end to the second valve element 42 is urged leftward by the second coiled spring 40, the valve rod 34 slides rightward together with the slider 20. This makes the first valve element 30 to slide rightward against the resilience of the coiled spring 28 to leave the first valve seat 26 open. Thus, the beer supplied through the beer supply pipe 48 is poured and the beer pouring nozzle 14 through the beer supply channel 12 into a mug 70 shown in FIG. 8.

Figure 5:
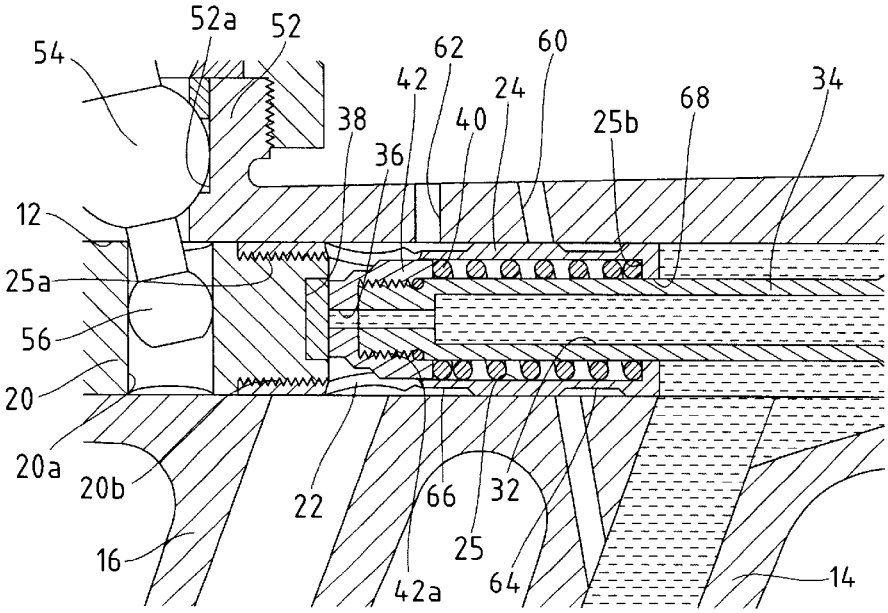
FIG. 5 is an enlarged view of a pertinent portion showing the positional relationship of the sleeve in FIG. 4.

Here, the second valve element 42 is urged axially leftward by the coiled spring 40 as shown in the enlarged view of a pertinent portion of FIG. 5, so that it is seated on the second valve seat 38 to close the narrow hole 36. Therefore, no froth is supplied to the froth pouring nozzle 16 at this stage. Further, since the slider 20 has moved rightward by the first operation of the lever 18, the communication between the first annular groove 64 of the sleeve 24 and the first air vent 60 of the spout body 10 is interrupted. Thus, there occurs no introduction of the outside air into the beer pouring nozzle 14 to prevent effectively excessive frothing which can be caused by migration of air in pouring beer. Here, the slider 20 at the stage of the first operation is not in such a position as can interrupt the communication between the second annular groove 66 of the sleeve 24 and the second air vent 62 of the spout body 10. That is, since the outside air is introduced into the froth pouring nozzle 16, the froth remaining in the nozzle 16 is still caused to drop.

Figure 6:
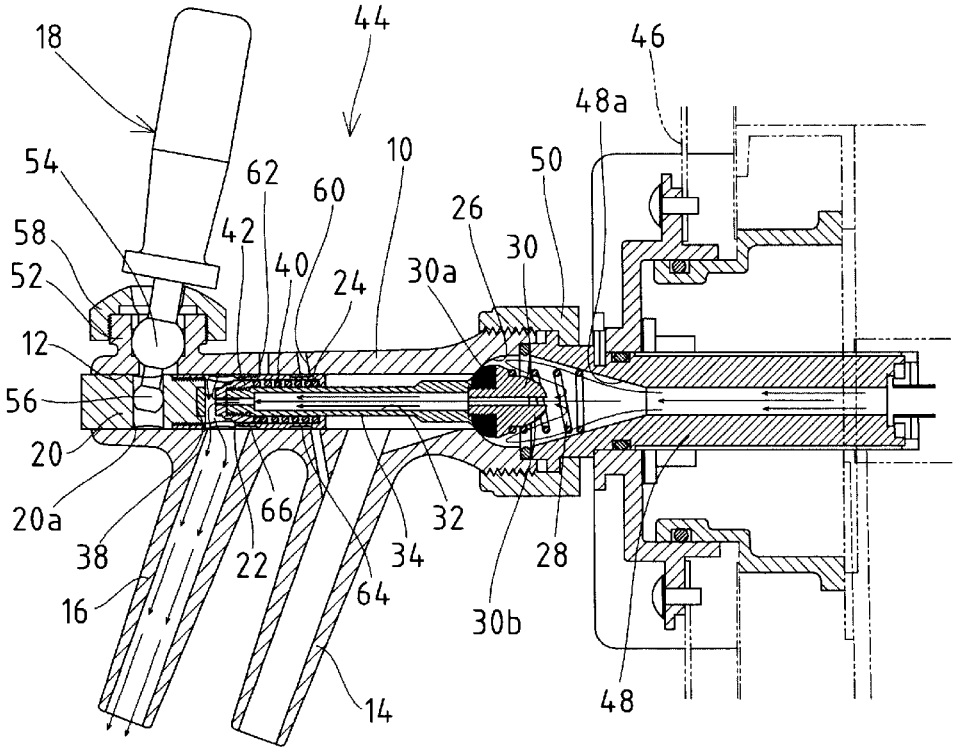
FIG. 6 is a cross-sectional view of the pouring spout for sparkling beverages according to the embodiment connected to the beverage supply pipe of a beverage server, showing a state where only fine froth is poured by a second operation of the lever.

As shown in FIG. 6, when the lever 18 is tilted backward (this operation is referred to as a second operation), the slider 20 advances leftward within the beer supply channel 12 against the resilience of the second coiled spring 40. Here, the valve rod 34 is resiliently urged leftward by the first coiled spring 28 through the first valve element 30, the valve rod 34 locates at the same position as in FIG. 2, where the lever 18 is at the neutral position. More specifically, the second valve seat 38 defined in the slider 20 is spaced away from the second valve element 42 fixed to the valve rod 34 to open the narrow hole 36 defined in the second valve element 42. Thus, the beer from the beer supply pipe 48 will flow out from the narrow hole 36 through the through hole 31 penetrating the first valve element 30 and the liquid passage 32 of the valve rod 34. However, since the narrow hole 36 has an inside diameter as very small as that of an orifice as explained before, the beer is converted into fine froth. Next, as shown in FIG. 7, the froth flows through the radial through holes 22 defined in the sleeve 24 into the froth pouring nozzle 16 and is poured additionally over the beer contained in the mug 70.

Figure 7:
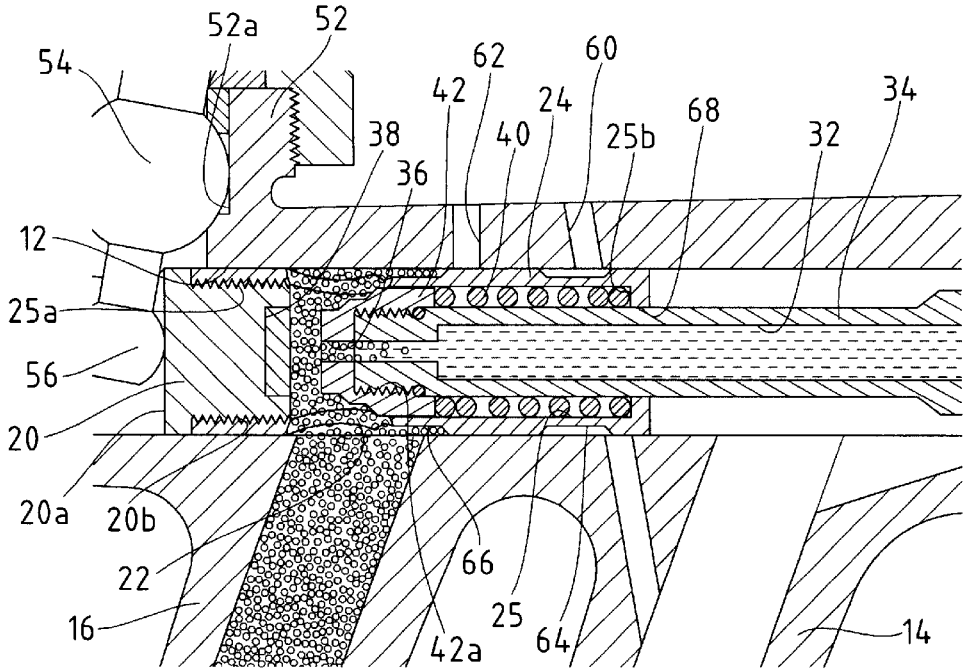
FIG. 7 is an enlarged view of a pertinent portion showing the positional relationship of the sleeve in FIG. 6.

As the enlarged view of a pertinent portion of FIG. 7 shows, the slider 20 is already moved leftward by the second operation of the lever 18, so that the communication between the second annular groove 66 of the sleeve 24 and the second air vent 62 of the spout body 10 is interrupted. Thus, there occurs no introduction of the outside air into the froth pouring nozzle 16, making it possible to form fine froth of high quality without migration of the outside air thereto. Incidentally, the slider 20 at the stage of the second operation is not in such a position as can interrupt the communication between the first annular groove 64 and the first air vent 60. That is, since the outside air is introduced to the beer pouring nozzle 14, the beer remaining in the nozzle 14 is still caused to drop by the air thus introduced.

Figure 9:
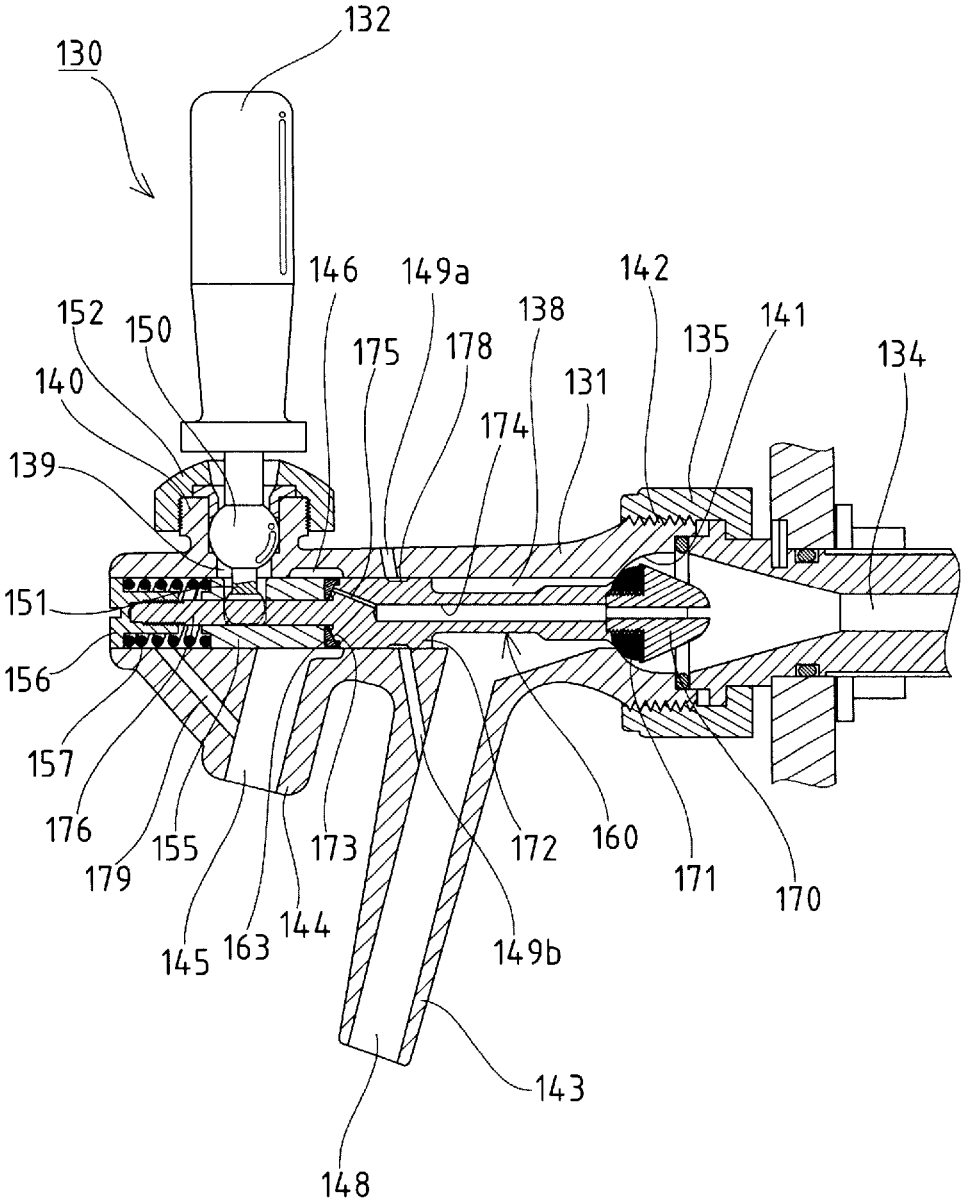
FIG. 9 is a cross-sectional view of the pouring spout for sparkling beverages according to another embodiment of the invention, in which the lever is located at the neutral position.
Figure 10:
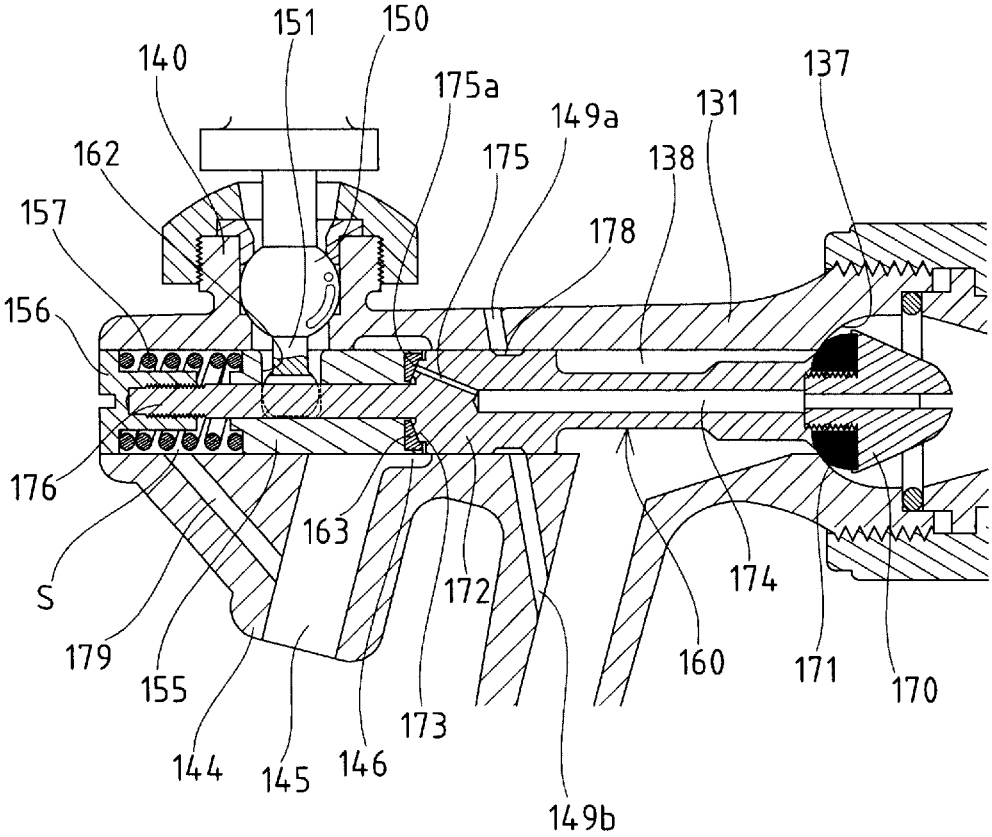
FIG. 10 is an enlarged view of a pertinent portion in FIG. 9.
Figure 11:
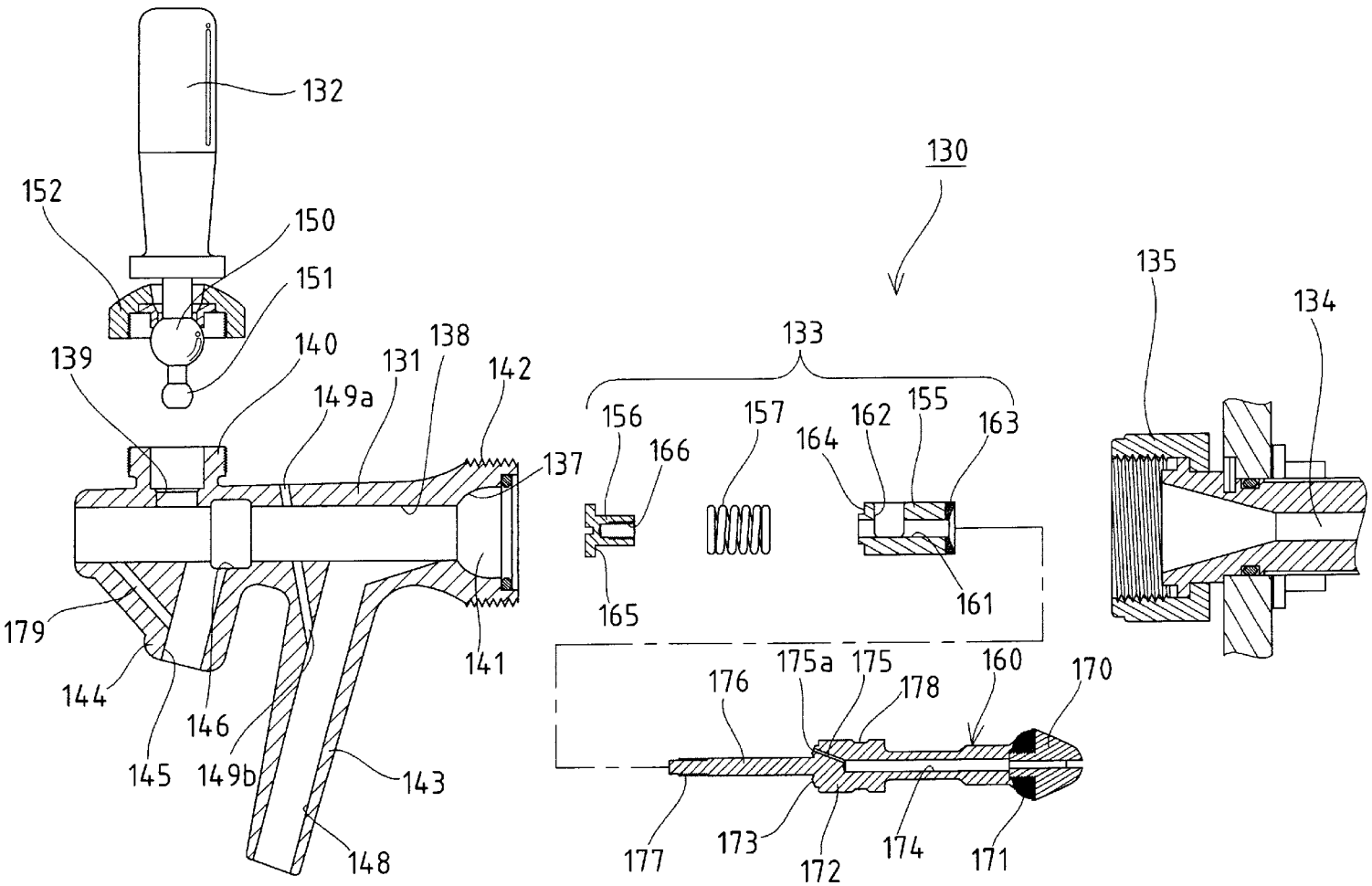
FIG. 11 is an exploded cross-sectional view showing components of the pouring spout for sparkling beverages, with the valve rod assembly being disassembled.

FIG. 9 is a cross-sectional view of the pouring spout for sparkling beverages according to another embodiment of the invention; FIG. 10 is an enlarged view of a pertinent portion in FIG. 9; and FIG. 11 is an exploded view. The sparkling beverage pouring spout 130, which is used, for example, for pouring beer into a mug, is composed essentially of a spout body 131, a lever 132 to be incorporated into the spout body 131 and to be tiltably operated manually, and a valve rod assembly 133 to be housed in the spout body 131. The pouring spout 130 is adapted to be fastened to the downstream end portion of a beer supply pipe 134 of a beer dispenser (not shown) with a female screw 135.

The spout body 131 has a cylindrical shape having a liquid passage 138 formed to penetrate through it in alignment with the center axis thereof. The spout body 131 also has a vertical hole 139 defined on the upper left side (opposite to the junction with the beer supply pipe 134), and an annular protrusion 140 formed along the outer opening of the vertical hole 139. At that end portion of the spout body 131 to be engaged with the female screw 135, the liquid passage 138 is expanded to form an expanded portion 141. The portion connecting the expanded portion 141 and the liquid passage 138 to each other is formed into a smooth hemispherical valve seat 137. Further, a male screw 142 to be engaged with the female screw 135 is formed on the external surface of the expanded portion 141.

The spout body 131 has a pair of nozzles formed on the lower side, i.e., a liquid pouring nozzle 143 formed as a longer cylindrical body closer to the expanded portion 141 and a froth pouring nozzle 144 formed as a shorter cylindrical body closer to the vertical hole 139 in which a lever 132 is to be fitted. While the froth pouring nozzle (pouring nozzle) 144 has a passage 145 communicating with the liquid passage 138, an annular groove 146 is defined on the internal surface of the spout body 131 circumferentially along the liquid passage 138 to overlap partly with the opening of the passage 145. Further, the liquid pouring nozzle 143 has a passage 148, and a pair of air vents 149*a* and 149*b* are defined on the upper side of the spout body 131 to communicate with the liquid passage 148.

The lever 132 has at the distal end a ball 150 to be pivoted freely in the annular protrusion 140, and a connecting rod 151 is provided to protrude from the distal end of the ball 150. The connecting rod 151 is notched or forked at the distal end. Further, a cover 152 is applied around the ball 150. The cover 152 is fitted liquid tight to the annular protrusion 140 to prevent leakage of the sparkling liquor.

The valve rod assembly 133 to be housed slidably in the liquid passage 138 of the spout body 131 consists essentially of a slider 155 capable of sliding in intimate contact with the internal surface of the liquid passage 138, a stopper 156 which slides along the liquid passage 138 to close the distal end opening (opposite to the opening of the expanded portion 141) of the liquid passage 138, a coiled spring serving as a resilient part 157 to be interposed between the slider 155 and the stopper 156, and a valve member 160.

The slider 155 has a center through hole 161 penetrating the center axis thereof and also an opening communicating with the center through hole 161 and opening 162 radially outward. The connecting rod 151 of the lever 132 is inserted to this opening 162 so that the slider 155 can slide leftward and rightward by tilting the lever 132 endways and backward. The slider 155 has a recess formed on the right end face thereof (facing the expanded portion 141), in which an annular sealing piece 163 having a conical internal face serving as a valve seat is fitted, and also a bearing seat 164 for the resilient part 157 formed on the left end face of the slider 155.

The stopper 156 has a bearing seat 165 for the resilient part 157 and also a bottomed hole 166 formed from the right end face in alignment with the center axis. The bottomed hole 166 has a female screw formed on the internal surface.

The valve member 160 is rod-shaped and is expanded at the proximal end portion to form a head serving as a first valve element (liquid pouring valve element) 170. The valve element 170 has an annular sealing piece 171 fitted to the neck thereof. The liquid passage 138 is designed to close when the annular sealing piece 171 is seated on the internal surface (valve seat 137) of the expanded portion 141 of the spout body 131. Further, the valve member 160 has a large diameter portion 172 at the middle thereof. The large diameter portion 172 has a second valve element (pouring valve element) 173 formed on that end face which is distal from the head. The second valve element 173 is adapted to be seated on the annular sealing piece 163 provided on the slider 155.

The valve member 160 has a bottomed through hole 174 defined from the end face of the head (first valve element) 170 thereof to the middle of the large diameter portion 172 in alignment with the center axis thereof. A narrow hole 175 through which a sparkling beverage flows is defined from the bottom of the bottomed through hole 174 in the large diameter portion 172 to the end face of the second valve element 173 to be abutted against the annular sealing piece 163. The narrow hole 175 has an opening 175*a* opening to the abutting face of the second valve element 173 toward the lever 132 rather than the froth pouring nozzle 144. Further, a rod 176 protrudes from the large diameter portion 172 in alignment with the center axis to be away from the head. The rod 176 has a male screw 177 formed at the distal end portion and is inserted to the center through hole 161 of the slider 155, and the male screw 177 formed at the distal end is engaged with the female screw of the bottomed hole 166 of the stopper 156, so that the stopper 156 and the valve member 160 move together. Incidentally, the large diameter portion 172 has a U-shaped groove 178 defined on the external surface thereof.

The valve rod assembly 133 of the sparkling beverage pouring spout 130 having the constitution as described above is obtained by putting four elements together, i.e. by inserting the rod 176 to the center through hole 161 of the slider 155 and to the resilient part 157 and bringing the distal end portion of the rod 176 into screw engagement with the bottomed hole 166. Then, the valve rod assembly 133 is inserted to the liquid passage 138 of the spout body 131, and after the connecting rod 151 of the lever 132 is inserted to the vertical hole 139 as if the forked end portion of the connecting rod 151 ride astride the rod 176 within the opening 162 of the slider 155, the cover 152 is screwed liquid tight onto the annular protrusion 140.

Finally, the male screw 142 formed on the external surface of the expanded portion 141 is inserted to the female screw 135 and is engaged therewith, and thus the sparkling beverage pouring spout 130 is connected to a beverage dispenser (see FIG. 9). In the state where the valve rod assembly 133 is incorporated into the spout body 131, the resilient part 157 is adapted to be housed in the housing space S defined by the internal surface of the spout body 131, the stopper 156 and the slider 155, as shown in FIG. 10. Further, a communicating passage 179 is formed through the portion of the spout body 131 defining housing space S at a lower position to communicate with the passage 145 of the froth pouring nozzle 144. It should be noted here that, while the valve rod assembly 133 slides rightward and leftward within the liquid passage 138 to pour beer and froth respectively, the communicating passage 179 is designed to be located at a position where the housing space S communicates constantly with the froth pouring nozzle 144 regardless of the position of the valve rod assembly 133.

When the sparkling beverage pouring spout 130 is to be cleaned, it is disassembled into the state shown in FIG. 11. More specifically, the pouring spout 130 is disassembled into three components, i.e., the lever 132, the spout body 131 and the valve rod assembly 133, enabling easy cleaning of the spout 130 without disassembling the valve rod assembly 133 into individual parts (155, 156, 157 and 160).

As can be understood clearly from FIGS. 9 and 10, in the sparkling beverage pouring spout 130 of this embodiment, the resilient part 157 having much clearances admitting entrance of froth is housed in the housing space S defined in the spout body 131 on the left end side of the froth pouring nozzle 144, and neither froth nor a liquid to be poured into a mug is designed to flow into the space where the resilient part 157 is located.

In the state shown in FIGS. 9 and 10, where the lever 132 is at the neutral position, the opening 175*a* of the narrow hole 175 opening to the abutting face of the second valve element 173 is closed by the annular sealing piece 163 of the slider 155 under resilience of the resilient part 157. The sealing piece 171 attached to the head (first valve element 170) of the valve member 160 is subjected to the liquid pressure of the beer supplied from the beer supply pipe 134 to be pressed against the valve seat 137, so that the communication between the beer supply pipe 134 and the liquid passage 138 is interrupted.

Dimensions or positions of the elements in the pertinent portion of the pouring spout 130 will be described. The opening 175*a* of the narrow hole 175 on the valve element (173) side or the sealing piece 163 is adapted to overlap with the location of the annular groove 146 defined in the spout body 131. Further, the air vents 149*a* and 149*b* are positioned to oppose the annular groove 178 defined on the external surface of the large diameter portion 172 of the valve member 160. When the valve member 160 is moved leftward from the neutral position, the communication of the air vents 149*a* and 149*b* with the annular groove 178 is designed to be interrupted (see FIG. 12). Further, the annular groove 146 and the passage 145 of the froth pouring nozzle 144 are staggered from each other by the length from the point of contact between the elongation of the substantially conical open face of the sealing piece 163 expanding toward the large diameter portion 172 and the internal surface of the annular groove 146 to the internal surface of the through hole 145.

Next, operations of the sparkling beverage pouring spout according to the second embodiment will be described.

As mentioned already, when the lever 132 is at the neutral position (as shown in FIG. 9), neither beer nor froth is poured. More specifically, before the lever 132 is operated, the liquid pressure of beer resiliently urges the sealing piece 171 in the first valve element 170 to be seated on the valve seat 137 to interrupt supply of beer from the beer supply channel 134 to the liquid passage 138 defined in the spout body 131. Meanwhile, since the slider 155 is urged by the resilient part 157 toward the valve member 160, the sealing piece 163 provided on the right end face of the slider 155 is pressed against the second valve element 173 to close the opening 175*a* of the narrow hole 175. Thus, both supply of beer to the liquid pouring nozzle 143 and supply of froth to the froth pouring nozzle 144 are interrupted.

When the lever 132 is at the neutral position, the annular groove 178 formed on the external surface of the large diameter portion 172 of the valve member 160 is adapted to oppose the air vents 149*a* and 149*b* defined in the spout body 131, so that the outside air is introduced into the liquid pouring nozzle 143. Thus, the beer remaining on the internal surface of the liquid pouring nozzle 143 after the previous beer pouring operation is caused to drop and discharged easily by the introduction of air.

Figure 12:
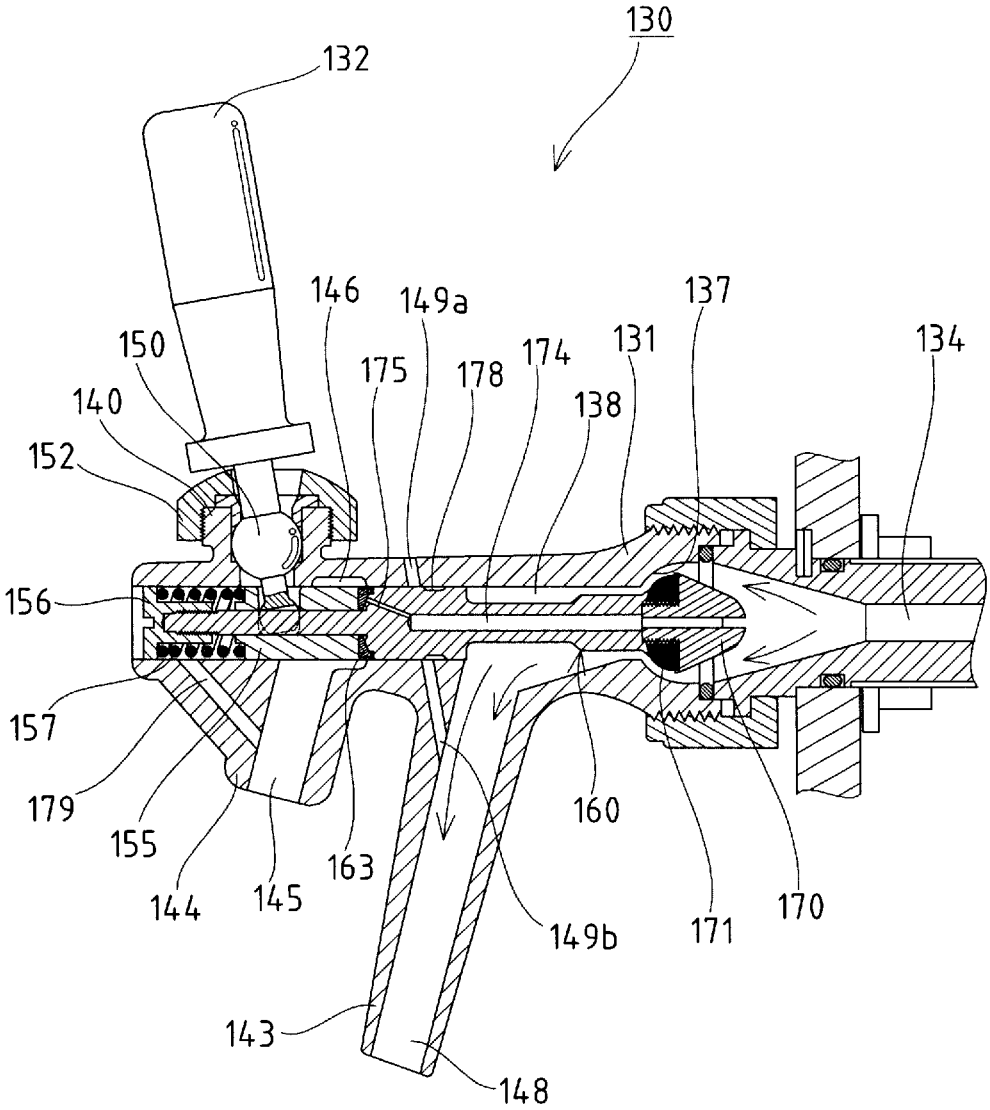
FIG. 12 is a cross-sectional view of the pouring spout for sparkling beverages, showing a state where the lever shown in FIG. 9 is tilted to shift to a liquid pouring position.
Figure 13:
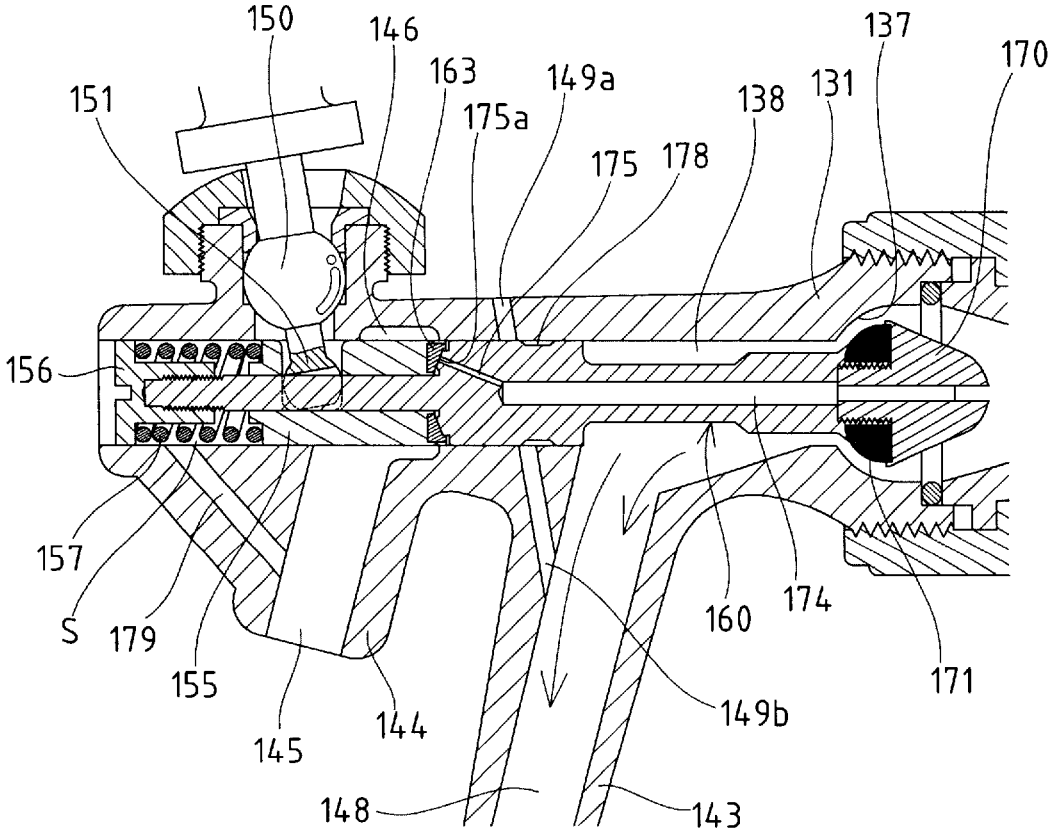
FIG. 13 is an enlarged view of a pertinent portion in FIG. 12.

When beer is poured into a mug, the lever 132 is tilted leftward as shown in FIG. 12. Thus, the slider 155 slides together with the valve member 160 toward the beer supply pipe 134, and the first valve element 170 retracts from the valve seat 137, as shown in the enlarged view of a pertinent portion. Therefore, beer flows from the beer supply pipe 134 successively into the liquid passage 138 and the passage 148 of the liquid pouring nozzle 143 to be poured into a mug (not shown).

In this state, or in the state where the large diameter portion 172 of the valve member 160 has slid toward the valve seat 137, the communication between the annular groove 178 and the air vents 149*a* and 149*b* is interrupted. Thus, there occurs no introduction of the outside air into the liquid pouring nozzle 143 through the air vents 149*a* and 149*b*, preventing excessive frothing which can be caused by migration of air in pouring beer.

When the lever 132 is returned to the neutral position so as to stop pouring of beer, the pouring spout resumes the state shown in FIG. 9, where the annular groove 178 opposes the air vents 149*a* and 149*b*. Thus, the outside air is introduced into the liquid pouring nozzle 143 to purge the beer remaining in the liquid pouring nozzle 143 to the outside.

Figure 14:
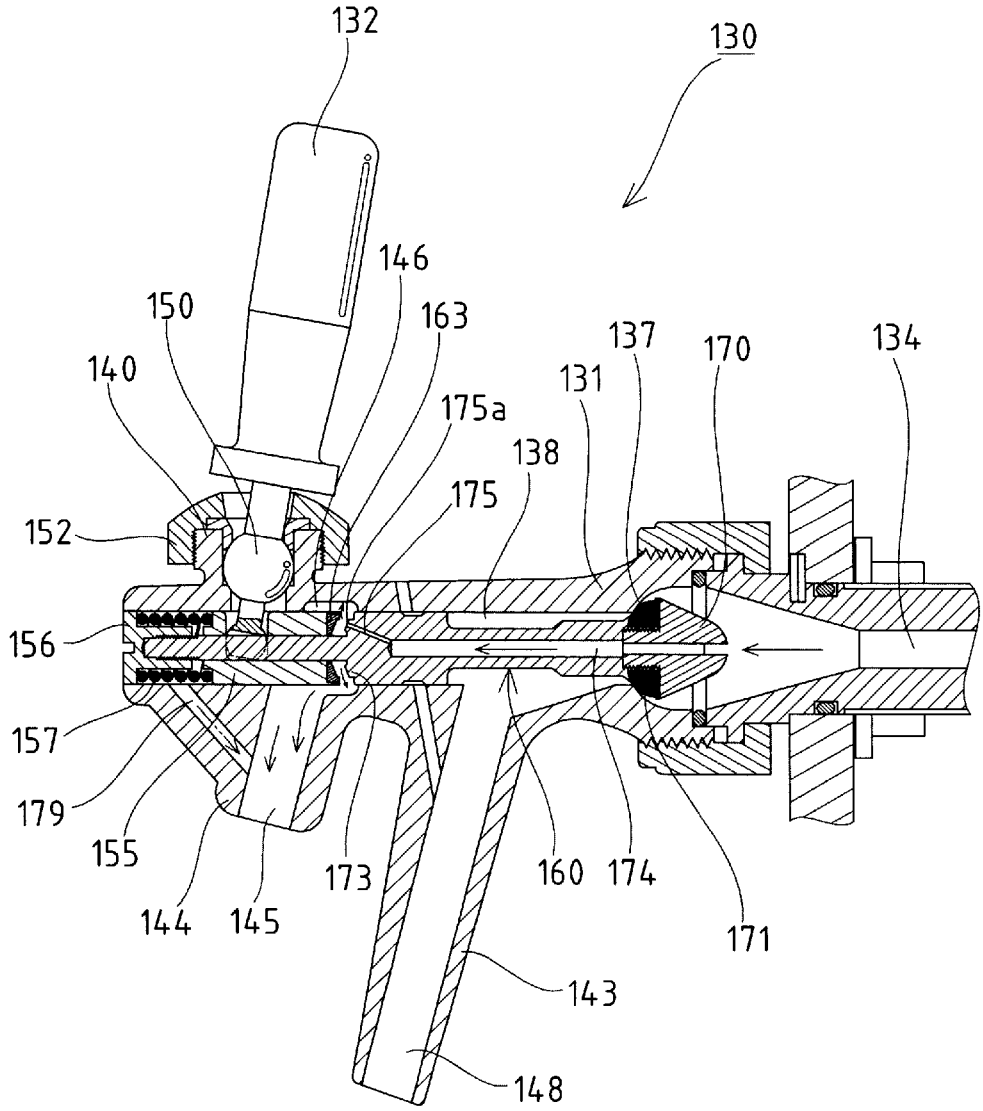
FIG. 14 is a cross-sectional view of the pouring spout for sparkling beverages, showing a state where the lever shown in FIG. 9 is tilted to be shifted to a froth pouring position.

Next, the lever 132 is tilted rightward in FIG. 14 so as to pour froth into the mug. This causes the slider 155 to slide leftward against the resilience of the resilient part 157 as shown in the enlarged view of a pertinent portion in FIG. 15. Here, the first valve element 170 is pressed against the valve seat 137 by the liquid pressure of the beer, so that the valve member 160 is located at a position where it cannot slide leftward any more. In other words, when the lever 132 is tilted rightward, the slider 155 slides leftward to cause the sealing piece 163 to retract from the second valve element 173 and opens the opening 175*a* of the narrow hole 175.

Thus, the beer in the beer supply pipe 134 flows into the bottomed through hole 174 opening to the head end face of the first valve element 170 to be jetted through the opening 175*a* of the narrow hole 175. The narrow hole 175 is designed to have a diameter as very small as that of an orifice, so that beer is jetted out vigorously to impinge against the valve seat or sealing piece 163 opposing the narrow hole 175. Thus, the beer is converted into find froth. The froth having no other channel to go flows downward along the annular groove 146 from the top thereof, whereas the impetus of the froth is attenuated. The froth then enters the passage 145 of the froth pouring nozzle 144 and is poured as additional froth over the top of the beer contained in the mug. The froth flowing down along the annular groove 146 is sealed from the resilient part 157 by the slider 155 sliding within the liquid passage 138 in intimate contact therewith, so that froth is prevented from dwelling in the space where the resilient part 157 is housed.

Figure 15:
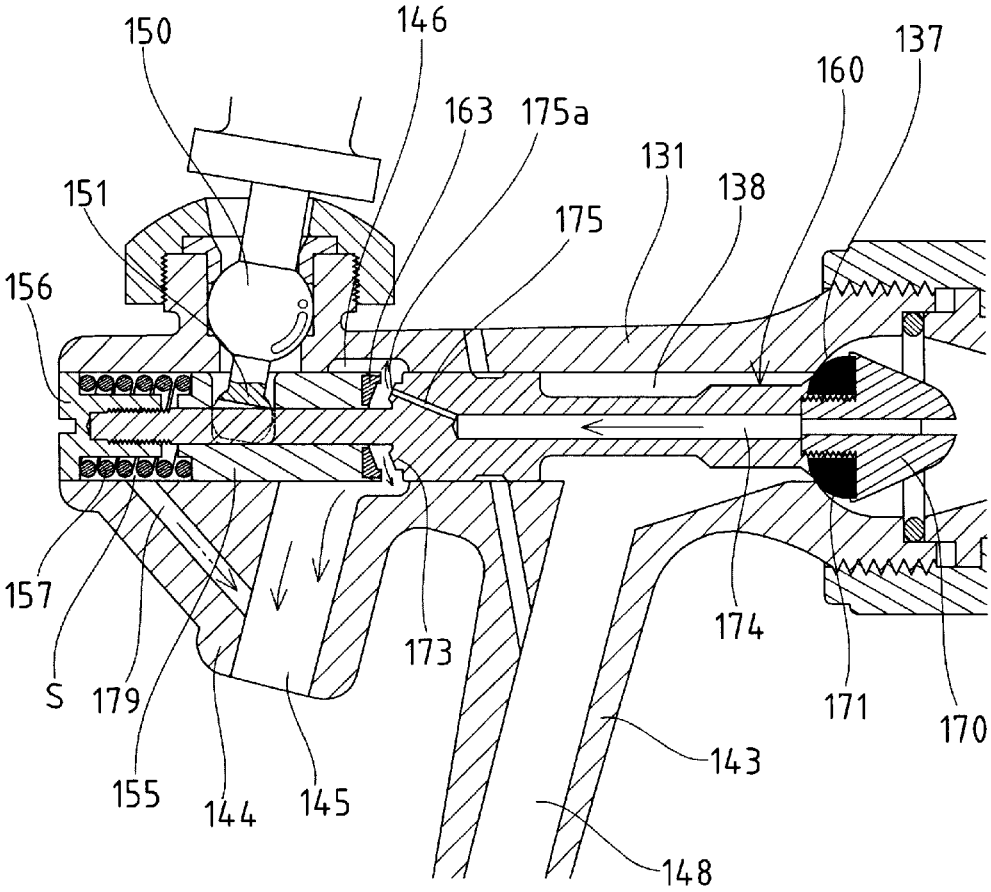
FIG. 15 is an enlarged view of a pertinent portion in FIG. 14.

Further, at the time of pouring froth, the slider 155 capable of sliding within the liquid passage 138 in intimate contact with the internal surface of the passage 138 is caused to approach the stopper 156 that is regulated not to move by the first valve element 170 pressed against the valve seat 137 of the first valve element 170, as shown in FIG. 15, reducing the volume of the housing space S in which the resilient part 157 interposed between the slider 155 and the stopper 156 is housed. The housing space S communicates with the passage 145 of the froth pouring nozzle 144 through the communicating passage 179, so that when the air present in the housing space S is compressed, the air is exhausted through the communicating passage 179 into the passage 145 of the froth pouting nozzle 144. In other words, the air in the housing space S is not exhausted to the outside of the spout body 131 along the external surface of the stopper 156, preventing leakage of froth or beer together with the air and contamination of the external surface of the spout body 131.

In this embodiment, the position of the annular groove 146 is staggered from the location of the passage 145 in the froth pouring nozzle 144 toward the expanded portion 141 so as to prevent the beer jetted out through the thin hole 175 and impinged against the sealing piece 163 from flowing in the form of strong current directly into the froth pouring nozzle 144. Therefore, the impetus of the froth entering the nozzle 144 is further attenuated. Thus, even if the froth pouring nozzle 144 is short, the froth does not form turbulence when it is poured but forms a laminar flow to flow down the froth pouring nozzle 144. In other words, there is no need of increasing the length of the froth pouring nozzle 144 in order to attenuate the impetus of the froth, but the nozzle 144 can be allowed to have the smallest possible length, thus reducing after dripping of froth (to be described later).

When the lever 132 is returned to the neutral position so as to stop pouring of froth, the pouring spout resumes the state as shown in FIG. 9, where the slider 155 is resiliently urged by the resilient part 157 to press the sealing piece 163 against the second valve element 173, and the sealing piece 163 closes the thin hole 175. After formation of froth is stopped, there remains some froth within the annular groove 146 and in the passage 145 in the froth pouring nozzle 144, i.e., some froth remains in the froth channel. However, the residual froth is present in a small amount and has a small dead weight and a high viscosity, the froth remains adhered for a while in the annular groove 146 and in the passage 145 of the froth pouring nozzle 144. Incidentally, when the housing space S for the resilient part 157 resumes the original volume, air is introduced into the housing space S through the froth pouring nozzle 144 and the communicating passage 179.

After dwelling for a while in the froth flow channel, the froth disintegrates to resume the liquid form and drips as such, so that the froth left in the channel after the previous froth pouring operation does not drop as such but, if dropped, in the liquid form. The amount of the resulting liquid if any is very small, and it merely drops into a mug without undergoing frothing after beer is poured into the mug, causing no excessive frothing. Therefore, there is no need of securing waiting time until the next beer pouring operation, but beer can be poured into another mug immediately after completion of the froth pouring operation. Meanwhile, the beer froth deposited on the internal surface of the annular groove 146 of the spout body 131 and that of the passage 145 of the froth pouring nozzle 144 is poured together with the froth to be formed in the next froth pouring operation, so that there is no froth remaining in the froth channel for a long time to cause no deterioration of beer.

Further, as described above, the sparkling beverage pouring spout 130 of this embodiment is of the structure where the housing space for the coiled spring as the resilient part 157 is not exposed to the froth channel for pouring froth into a mug. Therefore, this structure is more hygienic than the conventional structure, since large amounts of froth and beverage formed after liquefaction of froth are prevented from remaining deposited on the coiled spring having many clearances. Meanwhile, the pouring spout 131 can be cleaned easily, since the valve rod assembly 133 can be drawn out from the spout body 131 as an integral body merely by removing the female screw 135 and the lever 132.

It should be apparent to those skilled in the art that the present invention may be embodied in many other specific forms without departing from the spirit or scope of the invention.

In the embodiment described above, the pouring spout is of the structure where the froth pouring nozzle and the housing space for the resilient part communicate with each other. However, in a structure of sparkling beverage pouring spout, where only a sparkling beverage is poured in the form of liquid without additional pouring of froth, there may be employed a constitution, in which the housing space for the resilient part and the liquid pouring nozzle providing a liquid channel communicate with each other through a communicating channel. Further, this constitution can also be applied to a sparkling beverage pouring spout of the constitution where both a liquid and froth thereof is poured through a single nozzle.

Therefore, the present examples and embodiments are to be considered as illustrative and not restrictive, and the invention is not to be limited to the details given herein, but may be modified within the scope of the appended claims.

What is claimed is:

1. In a pouring spout for a sparkling beverage, having a constitution in which the sparkling beverage is poured into a vessel by a first operation of a lever, and froth of the sparkling beverage is poured additionally into the vessel by a second operation of the lever;

wherein the improvement which comprises:

a sparkling beverage pouring nozzle and a froth pouring nozzle branching out from a sparkling beverage supply channel defined in a spout body;

a slider inserted to the sparkling beverage supply channel to be slidable therein and is connected to the lever to be driven thereby to advance and retract;

a sleeve inserted slidably into the sparkling beverage supply channel and is connected at one end to the slider; the sleeve having through holes defined in the peripheral wall to be able to communicate with the froth pouring nozzle at the time of froth pouring operation;

a first valve element to be seated on a first valve seat provided at an inlet of the sparkling beverage supply channel under an action of a first resilient part;

a valve rod connected at one end to the first valve element and is inserted at the other end to the sleeve; the valve rod having a liquid passage defined axially therein to penetrate the first valve element; and a second valve element inserted to the sleeve and is connected at one end to the valve rod, the second valve element having an orifice defined at the other end to communicate with the liquid passage; wherein that end having the orifice is seated on a second valve seat provided in the slider under an action of a second resilient part;

wherein, before operation of the lever, the first valve element is seated on the first valve seat to interrupt flowing of the sparkling beverage into the sparkling beverage supply channel, whereas the second valve is seated on the second valve seat to close the orifice;

the first operation of the lever retracts the valve rod in the axial direction against the first resilient part through the second valve element being seated on the second valve seat to let the first valve element leave the first valve seat open and to pour the sparkling beverage out of the sparkling beverage pouring nozzle through the sparkling beverage supply channel;

the second operation of the lever causes the slider to advance in the axial direction against the second resilient part to be spaced away from the valve rod forcing the first valve element to seat on the first valve seat, and also causes the second valve element to leave the second valve seat open and effect frothing of the sparkling beverage from the liquid passage when it flows through the orifice to pour the resulting froth from the froth pouring nozzle through the through holes defined in the sleeve.

2. The pouring spout for a sparkling beverage according to claim 1, wherein the sleeve has on the external surface a first annular groove and a second annular groove defined at a necessary interval therebetween, whereas the spout body has a first air vent and a second air vent to allow the sparkling beverage supply channel to communicate with the outside; the sparkling beverage pouring nozzle and the froth pouring nozzle are designed to communicate with the first air vent and the second air vent through the first annular groove and the second annular groove, respectively, only at a fixed position of the sleeve before operation of the lever.

3. The pouring spout for a sparkling beverage according to claim 2, wherein the first operation of the lever interrupts communication between the first annular groove and the first air vent to stop introduction of the outside air into the sparkling beverage pouring nozzle, while communication between the second annular groove and the second air vent being maintained to introduce outside air still into the froth pouring nozzle.

4. The pouring spout for a sparkling beverage according to claim 2, wherein the second operation of the lever interrupts communication between the second annular groove and the second air vent to stop introduction of the outside air into the froth pouring nozzle, while communication between the first annular groove and the first air vent being maintained to introduce outside air still into the sparkling beverage pouring nozzle.

5. A pouring spout for a sparkling beverage, the spout comprising: a slider sliding within a liquid passage defined in a spout body in intimate contact therewith;

a lever connected to the slider and is tilted to slide the slider within the liquid passage;

a resilient part disposed on one end face of the slider so as to press a valve seat provided on the other end face of the slider against a pouring valve element disposed to oppose the latter end face;

a through hole for the sparkling beverage defined in the inside of the pouring valve element and opens to that end face against which the valve seat for the pouring valve element is pressed;

a pouring nozzle providing a channel of the sparkling beverage flowed out from an opening of the through hole opened by retraction of the valve seat from the pouring valve element when the slider is slid toward the other end face against the resilience of the resilient part; and a communicating passage for securing communication between a housing space defined in the spout body, in which the resilient part is housed and the pouring nozzle.

6. The pouring spout for a sparkling beverage according to claim 5, wherein the pouring valve element has a liquid pouring valve element and a rod formed integrally therewith at one end farther from the slider and at the other end closer to the slider, respectively; the rod is inserted to a center through hole of the slider and to the resilient part, the distal end of the rod being fixed to a stopper closing the distal end of the liquid passage such that the resilient part is retained between the stopper and the slider; and the housing space is defined by the internal surface of the spout body, the slider and the stopper.

7. A pouring spout for a sparkling beverage, the spout comprising: a slider sliding within a liquid passage defined in a spout body in intimate contact therewith;

a lever connected to the slider and is to be tilted to slide the slider within the liquid passage;

a resilient part disposed on one end face of the slider so as to press a valve seat provided on the other end face of the slider against a froth pouring valve element disposed to oppose the latter end face;

an orifice defined as a passage for the sparkling beverage introduced into the froth pouring valve element and opening to the froth pouring valve element;

an annular groove defined on the external surface of the spout body such that it provides a channel for froth formed when the sparkling beverage flowed out through the opening opened by retraction of the valve seat from the froth pouring valve element by sliding the slider toward that former end face against the resilience of the resilient part impinge against the valve seat; and a froth pouring nozzle communicating with the annular groove.

8. The pouring spout for a sparkling beverage according to claim 7, wherein the position of the froth pouring nozzle is staggered from the position of the annular groove.

9. The pouring spout for a sparkling beverage according to claim 7, wherein the opening is provided at an upper part of the froth pouring valve element, and froth formed is designed to flow downward along the annular groove from the top thereof into the froth pouring nozzle.

* * * * *